United States Patent [19]

Gajda

[11] 4,154,441

[45] May 15, 1979

[54] WEIGHT LIFTING DEVICE

[76] Inventor: Robert S. Gajda, 5000 Wilcox, Downers Grove, Ill. 60515

[21] Appl. No.: 809,784

[22] Filed: Jun. 24, 1977

[51] Int. Cl.[2] ..... A63B 21/06

[52] U.S. Cl. ..... 272/118; 272/117

[58] Field of Search ..... 272/118, 117, 119, 143, 272/DIG. 4, 120, 134; 273/191 B

[56] References Cited

U.S. PATENT DOCUMENTS

| | | | |
|---|---|---|---|
| 522,891 | 7/1894 | Grauert | 272/118 |
| 1,258,469 | 3/1918 | Ruden | 272/118 |

*Primary Examiner*—Richard C. Pinkham

*Assistant Examiner*—William R. Browne

*Attorney, Agent, or Firm*—Fitch, Even & Tabin

[57] ABSTRACT

An exercise apparatus for more specific full range muscle development. The apparatus includes at least one weight, a guide for the weight and a pulley affixed to the weight. A line is reeved through the pulley and one end of the line terminates in a handle by which the line can be grasped by a person utilizing the exercise device. The other end of the line is anchored. The weight is free to move on the guide when a force is applied to the handle. Since the pulley is affixed to the weight, the weight moves as the exercise device is utilized and the direction of application of force constantly changes.

6 Claims, 5 Drawing Figures

19
15
17
13'
21'
11'
13
21
11

27
28
31
33
35
41
25
43
23
39

54
53
47
57
65
61
55
49
59
45
51
63

WEIGHT LIFTING DEVICE

The present invention relates generally to an exercise device utilizing moveable weights. More particularly, the present invention is directed to an exercise device wherein the angle of application of force continuously changes during utilization of the exercise device.

Various types of exercise apparatus are known wherein a pulley and weight combination are used for limited range muscle development. In these prior art exercise devices, a line is led through a pulley or series of pulleys and is attached to a weight. The angle of pull in some devices is adjustable, but once adjusted is fixed and the angle of pull is constant. A person using such devices for exercise must change the angle of the body to work a muscle from a different angle so as to compensate for the limit/range ratio. This usually results in complete muscle development due to limit of range. Physical structural imbalances develop as a result of a foreshortening of the over-developed muscle, causing structural imbalance. Correction of the structural imbalances usually can only be effected by developing or working an antagonistic muscle over a full range. It would be desirable to provide an exercise device which can be used for specific full range muscle development and wherein a range of muscles are developed by utilization of the exercise device.

Accordingly, it is a principal object of the present invention to provide a pulley and weight type exercise device wherein the angle of pull is continuously varied as the exercise device is utilized.

It is another object of the present invention to provide an exercise device for more specific full range muscle development, particularly of an antagonist group.

It is a further object of the present invention to provide an exercise device wherein the angle of pull is continuously varied during utilization of the exercise device.

These and other objects of the invention will become more apparent from the following detailed description and the accompanying drawing wherein:

FIG. 5 is a further embodiment of the exercise device useful for an oblique high level pull exercise.

In general, the present invention is directed to an exercise apparatus for more specific full range muscle development. The apparatus includes at least one weight, a guide for the weight and a pulley affixed to the weight. A line is reeved through the pulley and one end of the line terminates in a handle by which the line can be grasped by a person utilizing the exercise device. The other end of the line is anchored. The weight is free to move on the guide when a force is applied to the handle. Since the pulley is affixed to the weight, the weight moves as the exercise device is utilized and the direction of application of force constantly changes.

Figure 1:
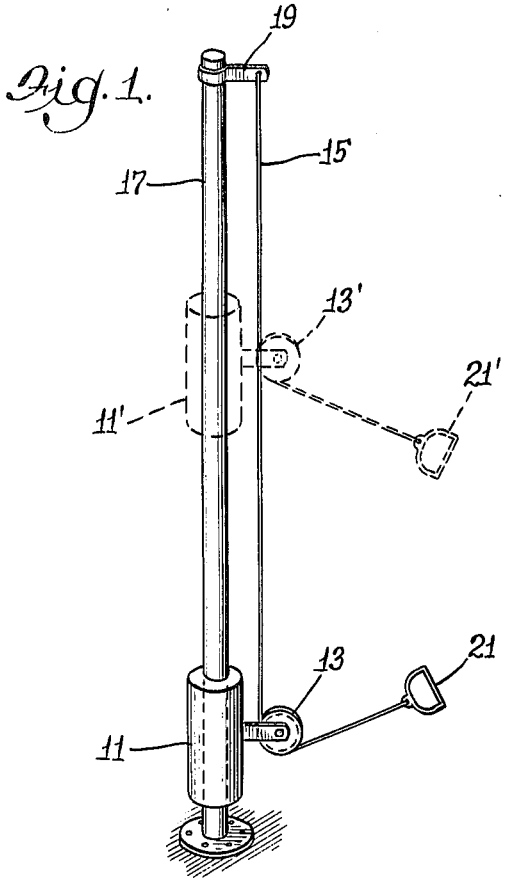
FIG. 1 is a schematic view of one embodiment of the exercise devide of the invention.

Referring now to the drawings, FIG. 1 shows exercise apparatus in accordance with the invention for a vertical upward exercise motion. As shown in FIG. 1, the exercise apparatus includes a weight 11, pulley 13 and line 15. The weight 11 is an annular cylinder which is free to slide on the column 17 which acts as a guide for the weight. The line 15 is reeved through pulley 13 and is anchored at one end by affixing the line to a support 19 mounted on the column 17. The other end of line 15 terminates in a handle 21 which is grasped by a user of the exercise apparatus.

As a force is applied to the handle 21 the weight 11 slides up the column 17 to a second position shown in phantom outline in FIG. 1. The component parts of the exercise apparatus in the second position are identified by the appropriate number with a prime. As can be seen from FIG. 1 the angle of pull changes as the weight 11 slides up the column 19. The angle of pull starts at an acute angle a the first position of the exercise device, moves through a right angle and becomes an oblique angle.

Figure 2:
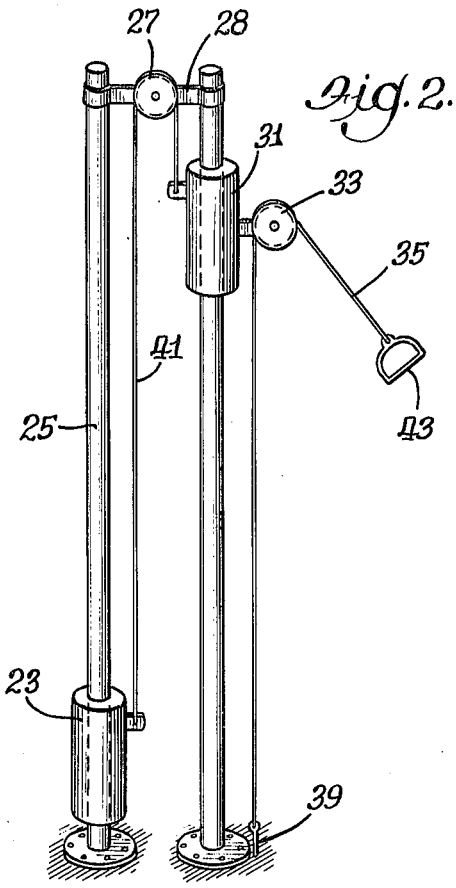
FIG. 2 is a further embodiment of the exercise devide of the invention useful for a downward pull exercise.

A further embodiment of the exercise apparatus of the invention is shown in FIG. 2. A first annular cylindrical weight 23 is mounted on a first column 25 which acts as a guide for the weight. A first pulley 27 is affixed to a support 28 between the first column 25 and a second column 29. A second annular cylindrical weight 31 is mounted on the second column 29. A second pulley 33 is affixed to the second weight 31. A first line 35 is reeved through pulley 33 and is affixed to the floor at 39. A second line 41 is reeved through pulley 27. The second line 41 is affixed at one end to weight 23 and at the other end to weight 31. A handle 43 is attached to the other end of the first line 35.

As a user of the exercise apparatus of FIG. 2 pulls on the handle 43, the first weight 23 moves up column 25 while the second weight 31 moves down column 29. As a result of the movement of the second weight 31 down column 29 the angle of pull constantly changes as force is applied to the handle 43.

Figure 3:
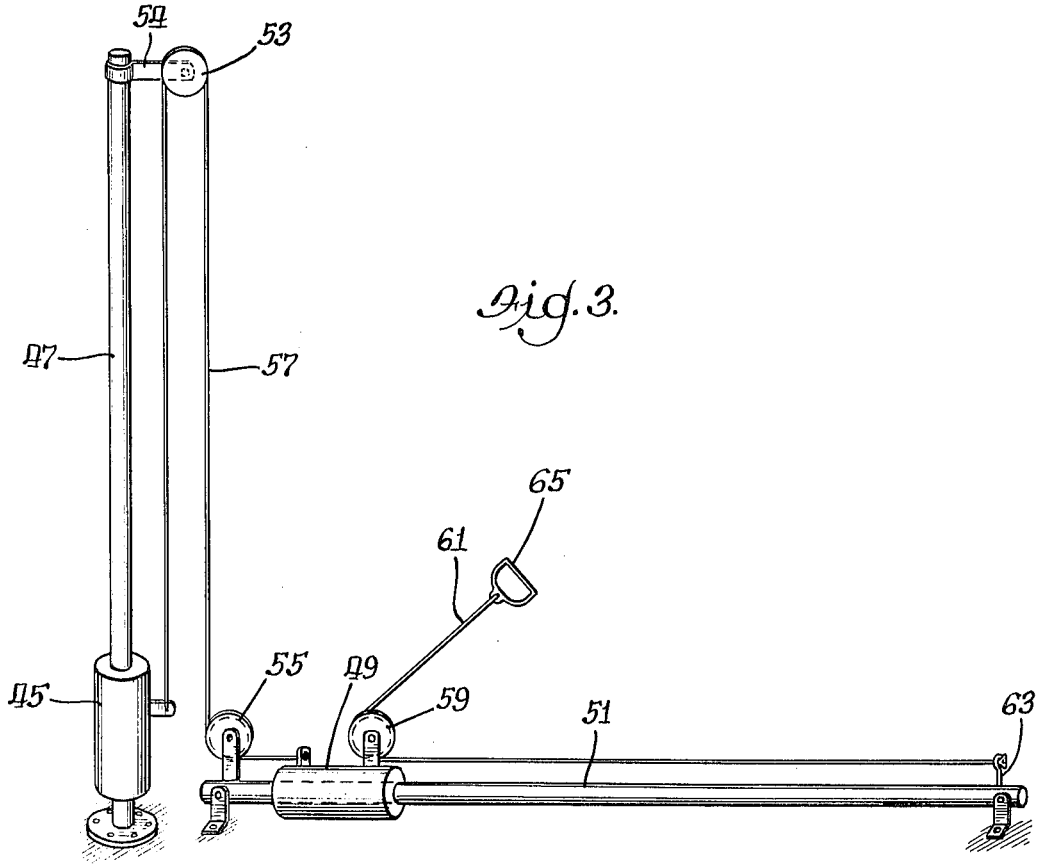
FIG. 3 is a further embodiment of the exercise device of the invention useful for a horizontal low level pull exercise.

Apparatus suitable for a horizontal low level pull is shown in FIG. 3. As set forth in FIG. 3, the apparatus includes a first annular cylindrical weight 45 mounted on a first verticle column 47 which acts as a guide for the weight. A second annular cylindrical weight 49 is mounted on horizontal column 51. A first pulley 53 is attached to a support 54 at the top of column 47. A second pulley 55 is attached to one end of a second horizontal column 51. A line 57 is reeved through pulley 53 and pulley 55. One end of the line is affixed to weight 45 and the other end of line 57 is affixed to weight 49. A third pulley 59 is attached to second weight 49. A second line 61 is reeved through pulley 59. One end of line 61 is affixed to the opposite end of column 51 at 63. The other end of line 61 terminates in a handle 65.

As a force is applied to the handle 65, weight 49 slides along column 51 to the right. At the same time weight 45 slides up column 47. As a result of the movement of weight 49 and 45, the angle of pull constantly changes as the exercise apparatus is utilized.

Figure 4:
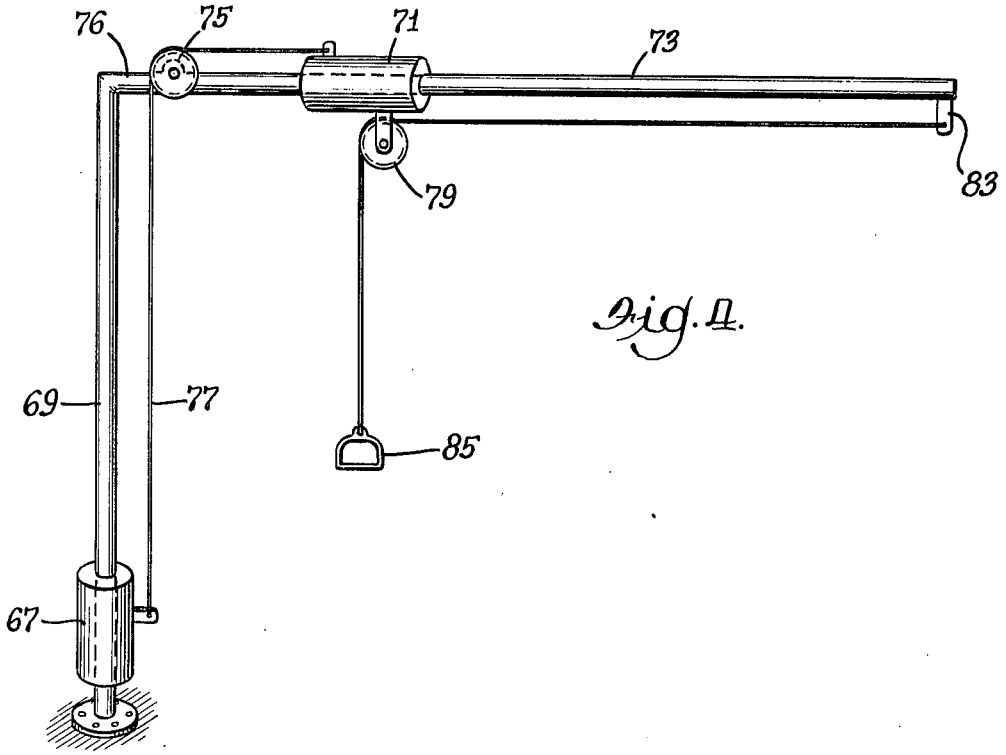
FIG. 4 is a further embodiment of the exercise device of the invention useful for a horizontal high level pull exercise.
Figure 4A:
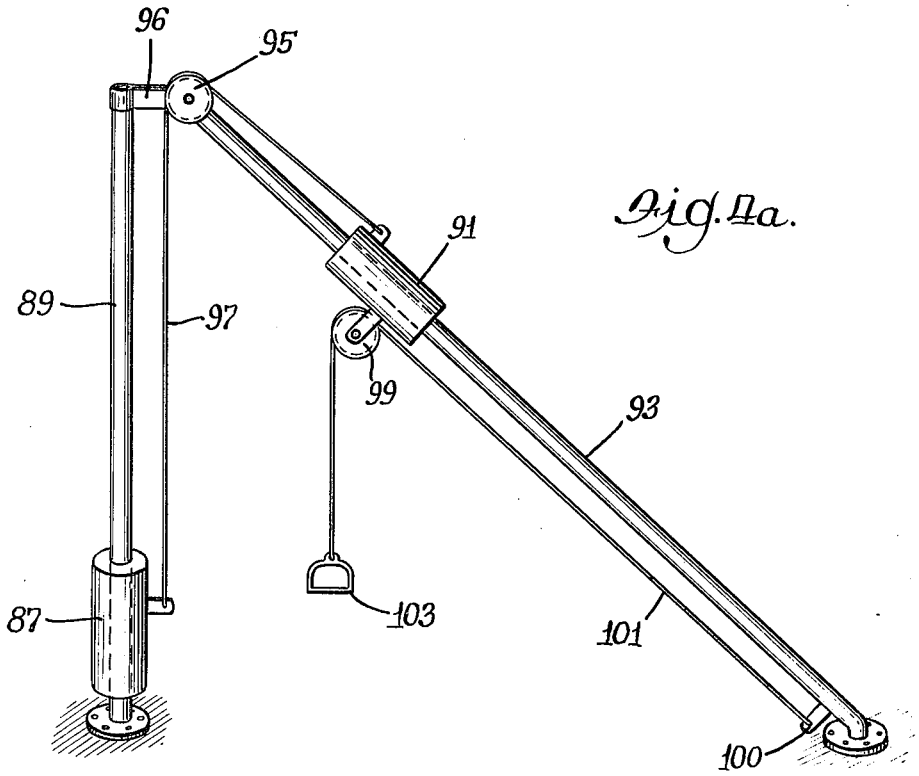

Exercise apparatus useful for a horizontal high level pull is shown in FIG. 4. As set forth in FIG. 4, the apparatus includes a first annular cylindrical weight 67 mounted on a first verticle column 69 which serves as a guide for the weight 67. A second weight 71 is mounted on a second horizontal column 73. A first pulley 75 is affixed to a support 76 at the top of column 69 and at the end of column 73. A line 77 is reeved through pulley 75. One end of the line 77 is affixed to weight 67 and the other end is affixed to weight 71. A second pulley 79 is mounted on weight 71. A line 81 is reeved through pulley 70. The line 81 is affixed at one end to the end of column 73 opposite pulley 75 and terminates at the other end in a grasping handle 85.

As a force is applied to the handle 85 the weight 71 slides to the right on column 73 while the weight 67 moves up column 69. As a result of the movement of weight 71 and 67 the angle of pull constantly changes as the exercise apparatus is utilized.

Apparatus suitable for an oblique high level pull is shown in FIG. 5. As set forth in FIG. 5 the apparatus includes a first annular cylindrical weight 87 mounted on a first verticle column 89 which acts as a guide for the weight 87. A second annular cylindrical weight 91 is mounted on a second column 93 which serves as a guide for the weight 91. The second column 93 is positioned at an angle to the first verticle column 89. A first pulley 95 is affixed to a support 96 between the top of column 89 and the upward end of column 93. A line 97 is reeved through the pulley 95. One end of the line 97 is affixed to weight 91 and the other end is affixed to weight 87. A second pulley 99 is affixed to weight 91. A second line 101 is reeved through pulley 99. The second line 101 is affixed at one end to a support 100 at the downward end of column 93. The other end of line 101 terminates in a handle 103.

As a force is applied to the handle 103 the first weight 91 slides downward on column 93, while the first weight 87 slides upward on column 89. As a result of the movement of weight 91 and weight 87 the angle of pull constantly changes as the exercise apparatus is utilized.

It is apparent that the exercise apparatus of the present invention is adaptable to many variations from the basic concept. Such variations are considered to be within the scope of the present invention as set forth in the appended claims.

What is claimed is:

1. An exercise apparatus for specific muscle development comprising at least one weight, guide means for said at least one weight during movement of said at least one weight, pulley means for offering a resistance during exercising, said pulley means affixed to said at least one weight, and a line reeved around said pulley means, one end of said line terminating in a grasping means, said grasping means being grasped by a user to operate on the line and said at least one weight and the other end of said line being affixed to anchor means which secures the other end of the line during an exercise, said at least one weight and said pulley being free to move on the guide means when a user's force is applied to said grasping means, said grasping means and said pulley means on said weight being directly connected by said line without passing said line through any intervening pulley means whereby the direction of application of a user's force with respect to the pulley means constantly changes during use.

2. An exercise apparatus in accordance with claim 1 wherein said guide means is a vertical column.

3. An exercise apparatus in accordance with claim 1 wherein a first weight is guided by a first vertical column, a second weight is guided by a second vertical column, said first weight having a rest position at the bottom of said first column, said second weight having a rest position at the top of said second column, a first pulley means located at the top of said columns and spaced between said columns, a first line reeved through said first pulley, one end of said first line being affixed to said first weight and the other end of said first line being affixed to said second weight, a second pulley affixed to said second weight and a second line reeved through said second pulley, one end of said second line terminating in a grasping device and the other end of said second line being affixed to an anchor device.

4. An exercise apparatus in accordance with claim 1, wherein a first weight is guided by a first verticle column, a second weight is guided by a second horizontal column, said second column being positioned at the base of said first column, a first pulley located at the top of said first column, a second pulley located at an end of said second column adjacent the base of said first column, a first line reeved through said first pulley and said second puelly, one end of the said first line being affixed to said first weight and the other end of said first line being affixed to said second weight, a third pulley affixed to said second weight, a line reeved through said third pulley, one end of said line terminating in a grasping device and one end of second line terminating in grasping device and the other end of said line being affixed to an anchor device said anchor device being located at the end of said second column opposite said second pulley.

5. An exercise apparatus in accordance with claim 1, wherein a first weight is guided by a first verticle column, a second weight is guided by a second horizontal column, said second column being positioned at the top of said first column, a first pulley located at the top of said first column, a second pulley located at an end of said second column adjacent the top of said first column, a first line reeved through said first pulley and said second pulley, one end of said first line being affixed to said first weight and the other end of said first line being affixed to said second weight, a third pulley affixed to said second weight, a line reeved through said third pulley, one end of said line terminating in a grasping device and one end of second line terminating in a grasping device and the other end of said line being affixed to an anchor device, said anchor device being located at the end of said second column opposite said second pulley.

6. An exercise apparatus in accordance with claim 1, wherein a first weight is guided by a first verticle column, a second weight is guided by a second inclined column, said second column being positioned at the top of said first column and extending downwardly therefrom, a first pulley located at the top of said first column, a second pulley located at an end of said second column adjacent the top of said first column, a first line reeved through said first pulley and said second pulley, one end of said first line being affixed to said first weight and the other end of said first line being affixed to said second weight, a third pulley affixed to said second weight, a line reeved through said third pulley, one end of said line terminating in a grasping device and one end of second line terminating in a grasping device and the other end of said line being affixed to an anchor device, said anchor means being located at the end of said second column opposite said second pulley.

* * * * *